US012195964B2

(12) United States Patent
Romans et al.

(10) Patent No.: US 12,195,964 B2
(45) Date of Patent: Jan. 14, 2025

(54) TONGUE-AND-GROOVE PANEL FOR IMPROVED INTERPANEL FIT

(71) Applicant: Huber Engineered Woods LLC, Charlotte, NC (US)

(72) Inventors: Timothy William Romans, Jefferson, GA (US); Jianhua Pu, Bishop, GA (US); Jason Corey Tolar, Decatur, GA (US); Brent Lawrence Flotkoetter, Huntersville, NC (US)

(73) Assignee: Huber Engineered Woods LLC, Charlotte, NC (US)

( * ) Notice: Subject to any disclaimer, the term of this patent is extended or adjusted under 35 U.S.C. 154(b) by 595 days.

(21) Appl. No.: 17/408,627

(22) Filed: Aug. 23, 2021

(65) Prior Publication Data

US 2022/0056692 A1 Feb. 24, 2022

Related U.S. Application Data

(60) Provisional application No. 63/069,376, filed on Aug. 24, 2020.

(51) Int. Cl.
*E04C 2/30* (2006.01)
*E04B 2/00* (2006.01)
(Continued)

(52) U.S. Cl.
CPC ..... *E04C 2/30* (2013.01); *E04B 5/12* (2013.01); *E04C 2/16* (2013.01); *E04C 2/44* (2013.01);
(Continued)

(58) Field of Classification Search
CPC ..... E04B 2/08; E04B 2/18; E04C 2/30; E04C 2/16; E04C 2/44; E04C 2002/004; E04F 2201/023; E04F 2201/027; E04F 15/02038
See application file for complete search history.

(56) References Cited

U.S. PATENT DOCUMENTS 4,095,913 A 6/1978 Pattersson et al.
4,807,416 A 2/1989 Parasin
(Continued)

FOREIGN PATENT DOCUMENTS

CA 2916506 12/2014
CA 2689077 4/2016
(Continued)

*Primary Examiner* — Adriana Figueroa
(74) *Attorney, Agent, or Firm* — Perilla Knox & Hildebrandt LLP

(57) ABSTRACT

A building-construction panel includes a tongue on one edge and a groove on an opposite edge that receives the tongue of an adjacent panel. A shoulder on the tongue-side edge defines an abutted surface that is contacted by an abutting surface on the groove-side edge to limit panel travel during installation and maintain a gap between upper edge portions of the adjacent panels. A bottom transition is formed on the groove-side edge so that the groove-side abutting surface is smaller than the tongue-side shoulder abutted surface. In this way, the relatively smaller groove-side abutting surface structurally maintains the gap but also minimizes frictional interpanel contact area to minimize squeaking. And the relatively larger tongue-side shoulder abutted surface helps keep the shoulder from being collapsed into the groove from overdriving the panels together during installation. In typical embodiments, the panel is a high-performance structural wood subflooring panel.

20 Claims, 7 Drawing Sheets

(51) Int. Cl.

| | |
|---|---|
| ***E04B 5/12*** | (2006.01) |
| ***E04C 2/16*** | (2006.01) |
| *E04C 2/00* | (2006.01) |
| *E04F 15/02* | (2006.01) |

(52) U.S. Cl.
CPC ... *E04C 2002/004* (2013.01); *E04F 15/02038* (2013.01); *E04F 2201/023* (2013.01)

(56) References Cited

U.S. PATENT DOCUMENTS

| | | | | |
|---|---|---|---|---|
| 5,165,816 | A | 11/1992 | Parasin | |
| 6,035,588 | A | 3/2000 | Zehner et al. | |
| 6,098,365 | A | 8/2000 | Martin et al. | |
| 6,131,355 | A | 10/2000 | Groh et al. | |
| 6,145,261 | A | 11/2000 | Godfrey et al. | |
| 6,397,548 | B1 | 6/2002 | Martin et al. | |
| 6,675,544 | B1 * | 1/2004 | Ou | E04F 15/04 52/592.4 |
| 6,772,569 | B2 | 8/2004 | Bennett et al. | |
| 6,851,241 | B2 | 2/2005 | Pervan | |
| 6,862,857 | B2 | 3/2005 | Tychsen | |
| 7,124,549 | B2 | 10/2006 | Weber | |
| 7,188,456 | B2 | 3/2007 | Knauseder | |
| 7,454,874 | B2 | 11/2008 | Ralf | |
| 7,506,481 | B2 | 3/2009 | Grafenauer | |
| 7,546,717 | B2 | 6/2009 | Juan Puerta | |
| 7,596,920 | B2 | 10/2009 | Konstanczak | |
| 7,640,664 | B1 | 1/2010 | Bailey et al. | |
| 7,644,556 | B2 | 1/2010 | Grohman et al. | |
| 7,827,749 | B2 | 11/2010 | Groeke et al. | |
| 7,930,862 | B2 | 4/2011 | Bergelin et al. | |
| 8,082,717 | B2 | 12/2011 | Dammers | |
| 8,176,698 | B2 | 5/2012 | Lewark | |
| 8,176,701 | B2 | 5/2012 | Cullen | |
| 8,191,334 | B2 | 6/2012 | Braun | |
| 8,215,078 | B2 | 7/2012 | Pervan | |
| 8,261,507 | B2 | 9/2012 | Hahn et al. | |
| 8,261,508 | B2 | 9/2012 | Thiers | |
| 8,429,870 | B2 | 4/2013 | Chen et al. | |
| 8,484,920 | B2 | 7/2013 | Thiers et al. | |
| 8,505,257 | B2 | 8/2013 | Boo et al. | |
| 8,528,290 | B2 | 9/2013 | Ph | |
| 8,534,003 | B2 | 9/2013 | Curry, III | |
| 8,544,231 | B2 * | 10/2013 | Hannig | E04F 15/02 52/592.1 |
| 8,584,432 | B2 | 11/2013 | Braun | |
| 8,793,956 | B2 | 8/2014 | Leopolder et al. | |
| 8,820,014 | B2 | 9/2014 | Durnberger | |
| 8,857,127 | B2 | 10/2014 | Windmoller | |
| 8,950,148 | B2 | 2/2015 | De Boe | |
| 8,966,851 | B2 | 3/2015 | Konstanczak | |
| 8,978,335 | B2 | 3/2015 | Kiefel et al. | |
| 8,991,056 | B2 | 3/2015 | Gerbl | |
| 9,103,128 | B2 | 8/2015 | Pomberger | |
| 9,145,681 | B2 | 9/2015 | Hannig | |
| 9,222,267 | B2 | 12/2015 | Bergelin et al. | |
| 9,228,360 | B2 | 1/2016 | Schneider | |
| 9,289,915 | B2 | 3/2016 | Trudel | |
| 9,322,183 | B2 | 4/2016 | Pervan | |
| 9,353,533 | B2 * | 5/2016 | Carrubba | E04F 13/0826 |
| 9,447,587 | B2 | 9/2016 | Wallin | |
| 9,476,202 | B2 | 10/2016 | Clancy et al. | |
| 9,476,208 | B2 | 10/2016 | Vermeulen et al. | |
| 9,556,620 | B2 | 1/2017 | Cappelle et al. | |
| 9,650,792 | B2 | 5/2017 | Ramachandra | |
| 9,670,683 | B2 | 6/2017 | Cappelle | |
| 9,695,601 | B2 | 7/2017 | Whispell et al. | |
| 9,745,756 | B2 | 8/2017 | Hannig | |
| 9,777,487 | B2 | 10/2017 | Pervan et al. | |
| 9,796,107 | B2 | 10/2017 | Bailey et al. | |
| 9,828,777 | B2 | 11/2017 | Dohring | |
| 9,856,658 | B2 | 1/2018 | Yang | |
| 9,945,130 | B2 | 4/2018 | Nygren et al. | |
| 9,951,525 | B2 | 4/2018 | Thiers | |
| 10,030,394 | B2 | 7/2018 | Simoens | |
| 10,214,916 | B2 | 2/2019 | Schulte | |
| 10,287,777 | B2 | 5/2019 | Boo | |
| 10,337,190 | B2 | 7/2019 | Tarananopas | |
| 10,450,760 | B2 | 10/2019 | Bergelin et al. | |
| 10,760,283 | B2 * | 9/2020 | Carrubba | E04F 15/02033 |
| 2006/0010820 | A1 * | 1/2006 | Schwitte | E04F 13/0846 52/592.1 |
| 2008/0295438 | A1 | 12/2008 | Knauseder | |
| 2016/0052709 | A1 * | 2/2016 | Kochanowski | B65D 90/08 403/363 |
| 2017/0016235 | A1 | 1/2017 | Hannig et al. | |
| 2017/0328072 | A1 | 11/2017 | Hannig | |
| 2018/0094441 | A1 | 4/2018 | Boo | |
| 2018/0195291 | A1 | 7/2018 | Loncke et al. | |
| 2018/0216353 | A1 * | 8/2018 | Hannig | E04F 15/02033 |
| 2019/0003188 | A1 * | 1/2019 | Loebel | E04F 15/02033 |
| 2019/0085569 | A1 | 3/2019 | Ryberg | |

FOREIGN PATENT DOCUMENTS

| | | | | |
|---|---|---|---|---|
| CH | 664185 | A5 * | 2/1988 | |
| EP | 1353023 | A2 * | 10/2003 | E04F 15/02 |
| FR | 1147651 | A * | 11/1957 | |
| WO | 2018228654 | | 12/2018 | |
| WO | 2019028737 | | 2/2019 | |

* cited by examiner

TONGUE-AND-GROOVE PANEL FOR IMPROVED INTERPANEL FIT

CROSS-REFERENCE TO RELATED APPLICATION

This application claims the priority benefit of U.S. Provisional Patent Application Ser. No. 63/069,376, filed Aug. 24, 2020.

TECHNICAL FIELD

The present invention relates generally to panels for use in building construction, and particularly to such panels having tongue-and-groove connections.

BACKGROUND

Wood panels with inter-engaging tongue-and-groove edges are well known and widely used in the construction industry. These panels are commonly constructed from plywood, particleboard, waferboard, oriented strand board (e.g., OSB), or other composite wood materials, and they are commonly constructed to meet a structural rating (e.g., PS 1 or PS 2 ratings by The Engineered Wood Association aka APA). Tongue-and-groove structural wood panels are particularly well suited for installation as sub-flooring on joist framing assemblies because the inter-engaging edges of the panels helps minimize vertical offset between adjacent panels, thereby providing a smoother structural sub-floor. In addition, the load-carrying and load-transferring capacity along the inter-engaged edges helps minimize relative movement between adjacent panel edges as persons walk along the floor, thereby reducing the potential for floor squeaking. Typically, flooring such as carpet, tile, or a hardwood is installed over the structural sub-floor to provide a finished floor surface.

While tongue-and-groove structural wood panels are generally very useful, they commonly swell and expand due to the absorption of moisture by the wood panels. This expansion causes the inter-engaged edges of the adjacent wood panels to press tightly against one another creating stress along the panel edges. As a result, the inter-engaged wood panels can begin to buckle and bow. In addition, the stress along the panel edges can cause undesirable popping, cracking, and/or squeaking when persons step upon or near the joints connecting the adjacent wood panels. To address this problem, these panels have been provided with a shoulder below the tongue that maintains a gap between the adjacent panel edges when installed with the tongue engaged in the groove, as disclosed by U.S. Pat. No. 6,675,544 to Ou.

During installation of such panels, however, sometimes the installer drives the panels together too much in an effort to ensure a good tight interpanel fit. This overdriving of the panels together can result in the shoulder (or at least a good portion of it) being forceably collapsed/compressed and driven into the adjacent groove, which causes the tongue-edge panel to deflect upward and the groove-edge panel to deflect downward, with this eccentric movement causing ridging of the inter-engaged panels (i.e., with a vertical offset between the major surfaces of adjacent panels) that leaves an uneven sub-floor surface. This also reduces or eliminates the gap between the panel edges, so the aforementioned problems tend to occur. For example, FIG. 1 shows two panels 10 installed properly with a shoulder 12 that maintains a gap 14 between the adjacent panel edges when installed with the tongue engaged in the groove, and FIG. 2 shows the same two panels 10 overdriven together (as indicated by the laterally inward directional arrows) with this causing ridging of the panel edges (as indicated by the angular directional arrows).

Accordingly, it can be seen that needs exist for tongue-and-groove panels with an improved interpanel fit to avoid ridging and minimize squeaking. It is to the provision of such solutions that the present invention is primarily directed.

SUMMARY

Generally described, the present invention related to building-construction panels that include a tongue on one edge and a groove on an opposite edge that receives the tongue of an adjacent panel. In typical embodiments, the panel is a high-performance structural wood subflooring panel.

In example embodiments, the panel includes a shoulder on the tongue-side edge that defines an abutted surface and that is contacted by an abutting surface on the groove-side edge to limit panel travel during installation and maintain a gap between upper edge portions of the adjacent panels. The panel also includes a bottom transition formed on the groove-side edge so that the groove-side abutting surface is smaller than the tongue-side shoulder abutted surface. In this way, the relatively smaller groove-side abutting surface structurally maintains the gap but also minimizes frictional interpanel contact area to minimize squeaking. And the relatively larger tongue-side shoulder abutted surface helps keep the shoulder from being collapsed into the groove from overdriving the panels together during installation.

The specific techniques and structures employed to improve over the drawbacks of the prior art and accomplish the advantages described herein will become apparent from the following detailed description of example embodiments and the appended drawings and claims.

DETAILED DESCRIPTION OF AN EXAMPLE EMBODIMENTS

Generally described, the present invention relates to tongue-and-groove panels with edge profile designs providing an improved interpanel fit. The improved panels can be structural wood panels (including planks, boards, etc.) of the type used in the building construction industry, for example composite wood panels such as plywood, particleboard, waferboard, oriented strandboard (e.g., OSB), and the like. In typical commercial embodiments, the panels are high-performance composite wood panels, which are stiffer and stronger (with a greater panel density and improved moisture-resistance resin) than traditional composite wood panels to provide better strength and stiffness performance and moisture resistance. Alternatively, the improved panels can be of another material and type used for building construction.

In addition, the improved panels are typically laid flat over and mounted down onto flooring joists to form a subfloor of a building structure. A floor covering (e.g., vinyl tiles, ceramic tiles, laminates, hardwoods, carpet, or another type of finished flooring) is installed over the subfloor paneling, with the subfloor being structural/load-bearing and with the floor covering being decorative but not structural/load-bearing. As such, the improved panels can be structural subfloor panels that are part of an overall/combined flooring system that also includes overlaid decorative flooring panels or another finished floor covering. Alternatively, the improved panels can be used for other applications in building construction such as for forming walls and roofs systems in the building structure.

Furthermore, the improved panels have mating tongue-and-groove features that inter-engage to prevent relative movement of the panels in a direction transverse to the plane of the tongues and grooves when installed together. That is, when used as subflooring, the generally linearly extending tongues and grooves inter-engage to prevent vertical movement of the installed panels. However, the tongue-and-groove features are typically not of the interlocking type (e.g., click-type) that interlock to prevent the panels from being moved apart longitudinally in the tongue-and-groove or installation plane (i.e., horizontally when used as subflooring). Alternatively, the improved panels can be provided with interlocking or another type of tongue-and-groove features for use in building construction applications to prevent the panels from being moved longitudinally/horizontally apart from each other.

Figure 3:
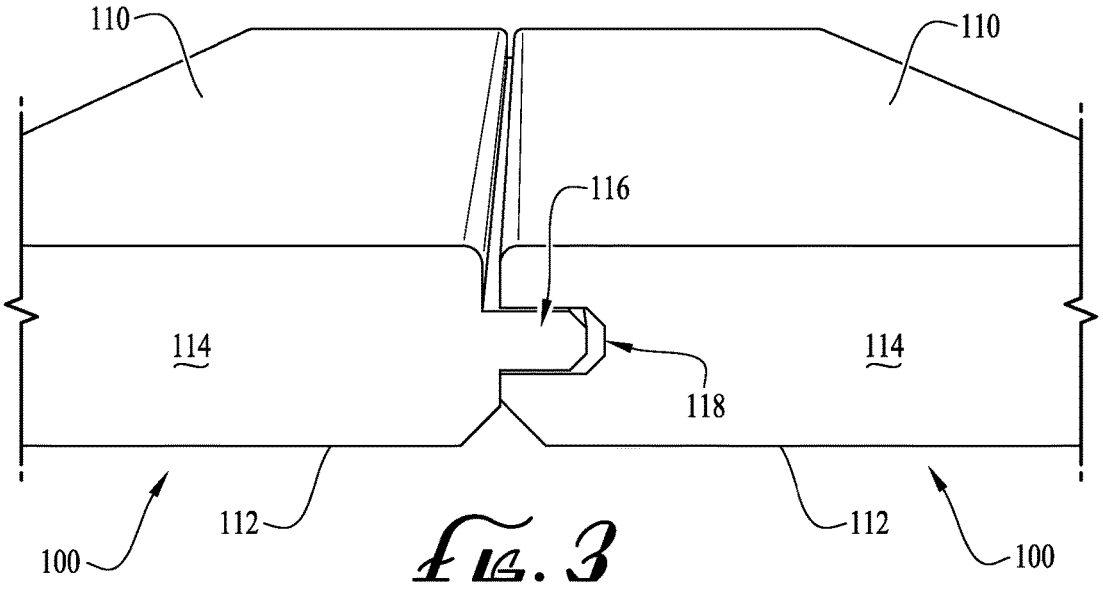
FIG. 3 is a perspective view of portions of two adjacent tongue-and-groove panels according to a first example embodiment, showing the panels inter-engaged together.
Figure 4:
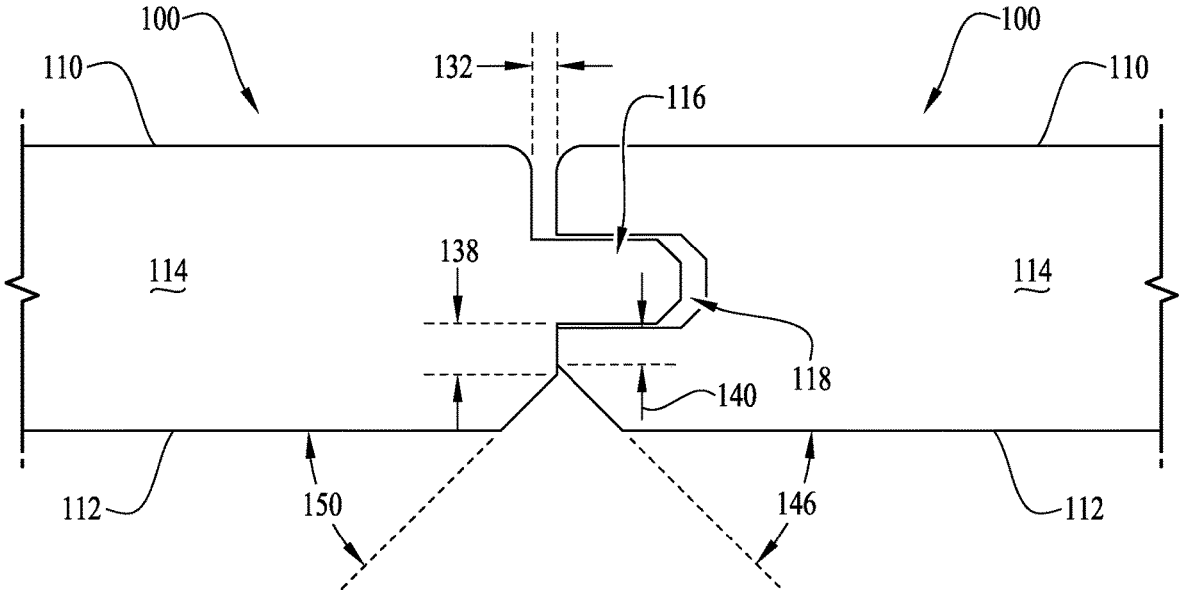
FIG. 4 is a side view of the two adjacent tongue-and-groove panel portions of FIG. 3.
Figure 5:
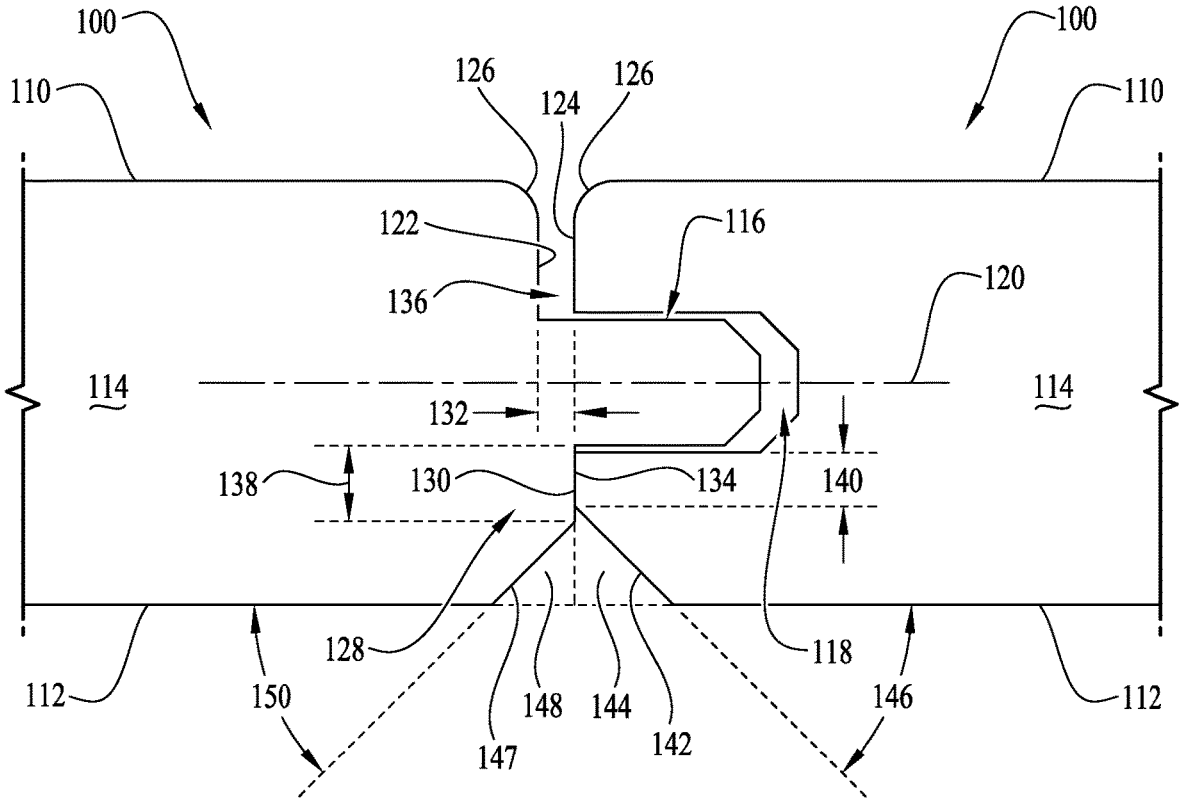
FIG. 5 is another side view of the two adjacent tongue-and-groove panel portions of FIG. 3.

FIGS. 3-5 show a panel 100 with an improved edge profile according to a first example embodiment. The panel 100 is sometimes referred to herein as the "SureFit" panel or the "SureFit T&G" panel.

The dimensions of the improved panel 100 as described herein are all representative for illustration purposes and are not limiting of the invention. In various embodiments the improved panel is provided in different thicknesses, for example standard sizes/thicknesses such as ⅜ inches, 7/16 inches, 15/32 inches, ½ inches, 19/32 inches, ⅝ inches, 23/32 inches, ¾ inches, ⅞ inches, 1.0 inches, 1⅛ inches, and 1¼ inches. As such, the depicted improved panel 100 has a 0.715-inch actual thickness and is thus a nominal thickness 23/32-inch panel, and is just one of a number of different thickness options for the panel. Also, the panels 110 are typically provided in 4-foot wide by 8-foot long sheets, though they can be provided in other sizes as may be desired in a given application.

The panel 100 includes a top major surface 110 and an opposite bottom major surface 112 that form the two major surfaces of the panel, with two opposite end surfaces 114 extending between them (e.g., at the panel transverse/width ends), and with two opposite side edges extending between them (e.g., at the panel longitudinal/length sides/edges), together defining a panel body. The panels 100 also include a tongue 116 extending from one edge and a groove 118 recessed into the opposite edge so that when two of the panels 110 are positioned flat adjacent to each other the tongue of one panel is matingly received into the groove of the adjacent panel in an inter-engaged arrangement.

The tongue 116 and the groove 118 are generally linearly arranged and aligned (e.g., horizontal) and symmetrical (e.g., centered) about a tongue-and-groove axis 120. The depicted tongue 116 and groove 118 are inter-engaging (to prevent relative vertical panel movement transverse to the tongue-and-groove axis 120) but not interlocking (they do not prevent relative horizontal panel movement away from each other along the tongue-and-groove axis 120). As such, the generally linear tongue 116 has generally flat/planar top and bottom opposing surfaces, and the generally linear groove 118 has generally flat/planar top and bottom opposing surfaces, with neither the tongue, the groove, nor any other portion of the panel including any interlocking features that would prevent horizontal movement of the panels laterally apart from each other.

In typical embodiments, the tongue 116 has a thickness (between its top and bottom surfaces) of about 0.190 inches to about 0.220 inches (e.g., the depicted 0.210 inches), and the groove 118 has a thickness (between its top and bottom surfaces) of about 0.225 inches to about 0.245 inches (e.g., the depicted 0.235 inches), for a 23/32-inch nominal thickness panel 100. These dimensions are scalable for the other panel sizes/thickness described herein.

The opposing panel sides/edges include a tongue-side ("T-side") panel edge surface and a groove-side ("G-side") panel edge surface. The T-side panel edge includes an upper edge surface 122 that extends all the way between the top surface of the tongue 116 and the top surface 110 of the panel 100 (the T-side upper edge surface 122), and the G-side panel edge includes an upper edge surface 124 that extends all the way between the top surface of the tongue 116 and the top surface 110 of the panel 100 (the G-side upper edge surface 124). The T-side upper edge surface 122 and the G-side upper edge surface 124 are typically generally planar/flat and parallel (and vertical) along their entire surfaces.

In the depicted embodiment, the panels 100 also have top transition surfaces 126 at the intersections between the top surface 110 and the respective upper edge surfaces 122 and 124. For example, the top transitions 126 can be rounded/filleted, as depicted, or they can have another shape (e.g., beveled/chamfered or another regular or irregular shape). As such, the top transitions 126 define panel voids (e.g., panel material removed during manufacture) resulting in the top surface 110 having a correspondingly smaller width (edge-to-edge) and the upper edge surfaces 122 and 124 having a correspondingly smaller height/thickness. Typically, the top transitions are much smaller/shorter than the bottom transitions (discussed in detail below), with the top surface 110 having a larger width (edge-to-edge) than the bottom surface 112. In typical embodiments, the top transitions 126 are rounded/filleted with an outer radius of less than about 0.125 inches (e.g., the depicted 0.0625 inches), though this can be scaled for the other panel sizes/thickness described herein.

In addition, the T-side panel edge includes a lower edge surface that extends all the way between the bottom surface of the tongue 116 and the bottom surface 112 of the panel 100 (the T-side lower edge surface), and the G-side panel edge includes a lower edge surface that extends all the way between the bottom surface of the tongue 116 and the bottom surface 112 of the panel 100 (the G-side upper edge surface 124).

The T-side lower edge includes a shoulder 128 positioned below the tongue 116 and extending laterally in the same direction as the tongue, for example with the shoulder 128 immediately adjacent, contiguous with, and extending downward from the bottom surface of the tongue 116. The shoulder 128 has an abutted surface 130 positioned at a lateral offset 132 from the T-side upper edge surface 122. And the G-side lower edge includes an abutting surface 134 positioned below the groove 118, for example with the abutting surface 134 immediately adjacent and connecting to the bottom surface of the groove 118. In typical embodiments such as that depicted, the T-side shoulder abutted surface 130 and the G-side abutting surface 134 are generally flat/planar, parallel, and facing each other. The T-side shoulder abutted surface 130 is contacted by the G-side abutting surface 134 to mechanically interfere with and thus structurally limit the lateral travel of two adjacent panels 100 as their tongue-and-groove features are being inter-engaged together during installation and to thereby leave a gap 136 formed between the upper edge surfaces 122 and 124 and extending from the tongue 116 all the way up to the top surface 110. The gap 136 thus typically has the same lateral dimension as the lateral offset 132 of the shoulder 128.

In order to prevent the shoulder 128 from being collapsed/compressed and forced into the groove 118, and thus the gap 136 being reduced or closed, during installation of the panels 100, the shoulder 128 is configured to form the abutted surface 130 with an increased height/thickness 138 relative to conventional panels 10. Because the shoulder 128 is thicker, its increased size and strength makes it more resistance to being collapsed into the groove 118 from overdriving the panels 100 together during installation. However, the resulting increased surface area of the T-side abutted surface 130 would tend to increase contact friction and thus frictional noises (e.g., squeaking and popping) of the inter-engaged panels 100 when used as subflooring and walked upon.

To overcome this issue, the G-side abutting surface 134 is provided with a decreased height/thickness 140 (and resulting contact surface area) relative to conventional panels 10. In particular, the height/thickness 140 of the G-side abutting surface 134 is less than (or equal to, but not greater than) the height/thickness 138 of the T-side abutted surface 130. That is, the T-side abutted surface 130 extends vertically higher and lower than the G-side abutting surface 134. The top of the G-side abutting surface 134 (defined by the intersection of the groove 118 and the G-side lower edge) is below the top of the T-side abutted surface 130 (defined by the intersection of the tongue 116 and the shoulder 118). And the bottom of the G-side abutting surface 134 (which is defined by the intersection of the G-side bottom transition 142 and the G-side lower edge) is above the bottom of the T-side abutting surface 134. So the top and bottom of the G-side abutting surface 134 contact the T-side abutted surface 130, but the top and bottom of the T-side abutted surface 130 do not contact the G-side abutting surface 134. So the lowest part of the G-side abutting surface 134 is higher than the lowest part of the T-side abutted surface 130.

This is in contrast to conventional panels 10, in which the smaller contact surface (the abutting surface) is on the T-side shoulder and the larger contact surface (the abutted surface) is on the opposite G-side edge, with the smaller abutting surface of the T-side shoulder designed with a balanced thickness so that it's small enough to minimize/avoid squeaking but large enough to maintain the gap 136 during proper installation (without overdriving the panel together). Instead, the improved panel 100 takes the innovative approach of relocating the two balanced functionalities of large-enough gap-maintaining contact area and small-enough non-squeaking contact area to the G-side. By doing this, the T-side shoulder 128 can now be provided with an increased size/thickness 138 to provide the added functionality of avoiding the shoulder collapsing/compressing into the groove 118, without causing increased squeaking. As such, the smallest contact area of the engaging T-side and G-side edge surfaces of the panels is located on the G-side edge of the panel 100.

To implement this, the groove-side edge further includes a bottom transition 142 at the intersection of the panel bottom surface 112 and the G-side abutting surface 134 (i.e., immediately above the panel bottom surface, leaving the abutting surface 134 intact). Effectively, this G-side bottom transition 142 is formed by a void 144 at the bottom G-side corner of the panel 100, for example by removing that respective panel corner during panel manufacture. The G-side bottom transition 142 can be a slanted/sloped surface (e.g., a bevel/chamfer or a fillet/curve), two rectilinear surfaces (formed by a rectangular void), or another regular or irregular surface. For example, the G-side bottom transition 142 can be beveled/chamfered at an angle 146 of about 25 degrees to about 60 degrees, such as the 45-degree bevel depicted. The reduced amount of wood material and the increased exposed surface area (and thus enhanced sealing, as described below) provide for reduced edge swelling of the panel 100.

Figure 12:
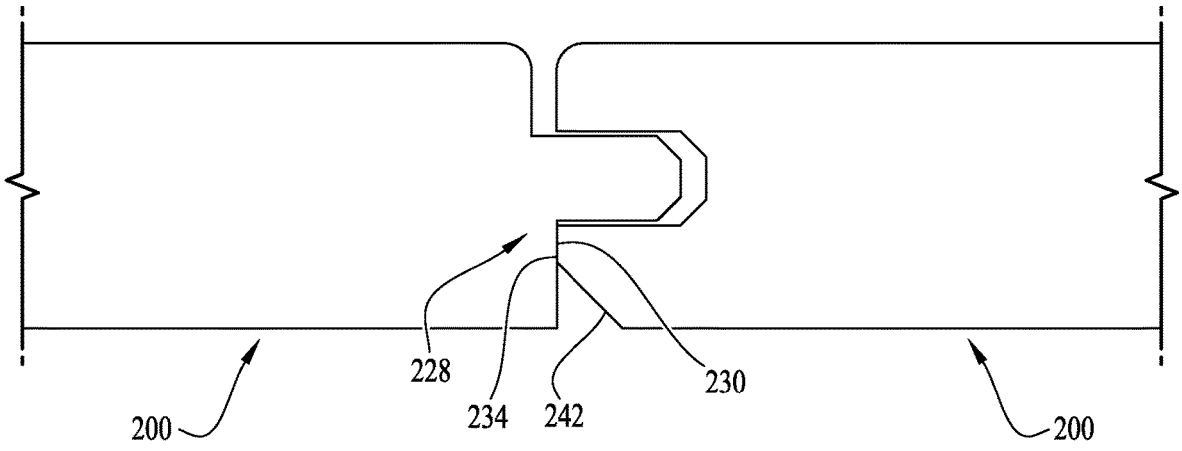
FIG. 12 is a side view of portions of two adjacent tongue-and-groove panels according to a second example embodiment, showing the panels inter-engaged together.

Because the T-side shoulder 128 is relieved of its functional role as providing a large-enough gap-maintaining contact area but small-enough non-squeaking contact area, the shoulder 128 (and thus the abutted surface 130 and its height/thickness 138) can extend all the way to the panel bottom surface 112 in some embodiments (e.g., see FIG. 12). In typical embodiments such as the depicted, however, the tongue-side edge also includes a bottom transition 147 at the intersection of the panel bottom surface 112 and the T-side abutted surface 130. Effectively, this T-side bottom transition 147 is formed by a void 148 at the bottom T-side corner of the panel 100, for example by removing that respective panel corner during panel manufacture. Because the T-side abutted surface 130 extends lower than the G-side abutting surface 134, the groove-side bottom transition 142 extends higher than the tongue-side bottom transition 147. The T-side bottom transition 147 can be a slanted/sloped surface (e.g., a bevel/chamfer or a fillet/curve), two rectilinear surfaces (formed by a rectangular void), or another regular or irregular surface. For example, the T-side bottom transition 147 can be beveled/chamfered at an angle 150 of about 25 degrees to about 60 degrees, such as the 45-degree bevel depicted. The reduced amount of wood material and the increased exposed surface area (and thus enhanced sealing, as described below) provide for reduced edge swelling of the panel 100. In such embodiments, the T-side bottom transition 147 can intersect with the panel bottom surface 112 at a location that is laterally farther away from the T-side abutted surface 130 than the T-side upper edge surface 122.

The corner voids 144 and 148 are sized to form (i.e., leave remaining) the T-side abutted surface 130 and the G-side abutting surface 134 with the abutted-surface height/thickness 138 being greater than the abutting-surface height/thickness 140. Because the T-side surface 130 is larger, it contacts all of the G-side surface 134 and is thus considered to be "abutted." Similarly, because the G-side surface 134 is smaller, it contacts only a portion of the T-side surface 130 and is thus considered to be "abutting." In some embodiments, the abutted-surface height/thickness is about the same as, but in no case is it less than, the abutting-surface height/thickness.

The G-side abutting surface height/thickness 140 can be optimized to provide the balanced-design contact area that is small enough to minimize frictional squeaking but large enough to provide sufficient structural lateral-compression strength so that it does not collapse/compress during an excessive-force installation situation. Based on the optimized G-side abutting surface height/thickness 140, the T-side abutted surface height/thickness 138 can then be selected to be larger than that so that it does not collapse/compress during an excessive-force installation situation. So while it may superficially appear that the T-side shoulder design by itself defines the functionality/performance of the panel 100, in fact it is primarily the G-side abutting surface design that does so, with the T-side shoulder design then based on that.

For example, for the depicted 23/32-inch nominal thickness panel 100, the G-side abutting surface height/thickness 140 is typically about 0.0312 inches to about 0.1 inches, with about 0.094 inches as in the depicted embodiment working well. And the T-side abutted surface height/thickness 138 can be about at least about 0.094 inches, such as about 0.1875 inches, or such as about the 0.125 inches in the depicted embodiment. These dimensions can be scaled for the other panel sizes/thicknesses described herein, except that the lateral interpanel gap, and the tongue-and-groove lateral gap (the difference of the lateral groove depth minus the lateral tongue length, which ensures the tongue tip does not contact the groove bottom before the intended T&G contact areas engage), would typically be about the same and not scaled up or down with the other profile dimensions.

For designing the panel 100 in the depicted or other sizes, the G-side abutting surface height/thickness 140 can be for example about 10 percent to about 16 percent of the panel height/thickness, such as about 13 percent. In the depicted embodiment, the G-side abutting surface height/thickness 140 of 0.094 inches is about 13 percent of the 0.715-inch panel height/thickness. Also, the G-side abutting surface height/thickness 140 can be for example about 35 percent to about 45 percent of the groove height/thickness, such as about 40 percent. In the depicted embodiment, the G-side abutting surface height/thickness 140 of 0.094 inches is about 40 percent of the 0.235-inch groove height/thickness. Further, the G-side abutting surface height/thickness 140 can be for example about 23 percent to about 33 percent of the combined height/thickness of the tongue 116 and the shoulder 128, such as about 38 percent. In the depicted embodiment, the G-side abutting surface height/thickness 140 of 0.094 inches is about 28 percent of the 0.335-inch combined tongue/shoulder height/thickness. Moreover, the G-side abutting surface height/thickness 140 is typically less than half the overall height/thickness of the G-side lower edge (between the bottom surface of the groove 118 and the bottom major surface 112 of the panel 100), for example the G-side abutting surface height/thickness 140 can be for example about 33 percent to about 40 percent of the G-side lower edge height/thickness, such as about 36.5 percent. In the depicted embodiment, the G-side abutting surface height/thickness 140 of 0.094 inches is about 36.5 percent of the 0.257-inch G-side lower edge height/thickness.

In some embodiments, the G-side abutting surface height/thickness 140 is a maximum of about 0.096 inches, about 0.098 inches, or about 0.100 inches, as larger could create an abutting contact area engaging the shoulder too large to avoid, or at least reduce to a negligible, any squeaking and popping, depending on the frictional properties of the material used in the panels. Also, in some embodiments, the G-side abutting surface height/thickness 140 is a minimum of about 0.80 inches, about 0.085, or about 0.090 inches, as smaller would leave an abutting contact area engaging the shoulder too small to ensure the interpanel gap doesn't collapse during installation, depending on the strength of the material used in the panels. These same actual minimum and maximum dimensions are applicable to and can be used for the other standard sizes of panels noted herein.

In addition, the tongue 116 has a slightly lesser height/thickness than the groove 118 to allow a smooth and easy installation, and as such the G-side abutting surface height/thickness 140 is greater than the T-side abutted surface height/thickness 138 by at least one-half of the height/thickness difference of the tongue and groove. For example, the tongue and groove thicknesses are selected in part to provide a T&G thickness difference, which is also determined in part by the manufacturing plant's operational requirements such as wood species, edge sealer application, etc. These thicknesses are also selected to provide a T&G thickness difference that balances the strengths of the T&G joint vertically so the optimum/maximum supporting strength/stiffness is obtained when either side/panel of the joint is loaded. In the depicted embodiment, the T&G thickness difference is 0.025 inches, based on the T thickness of 0.210 and the G thickness of 0.235 inches.

With the tongue approximately vertically centered in the groove, about half of the T&G thickness difference vertical gap (as depicted, about 0.0125 inches) is above the tongue and the other about half is below it, as depicted. With the minimum contact area on the G-side, the design ensures that of the entirety of the minimum contact area is engaged by the other contact area. This is compared to conventional designs, in which a portion of the T-side contact area is above the G-side contact area and not contacting another surface (due to the below the tongue portion of the T&G thickness difference vertical gap). As such, the G-side minimum contact area can be optimized to balance the need for enough contact area to prevent collapsing of the interpanel gap but not too much contact area that it causes squeaking and popping. In other words, by placing the minimum contact area on the groove side, this ensures 100-percent full usage of that contact area to effectively eliminate the possibility of the shoulder jamming into the groove, while minimizing the contact area to avoid frictional noises.

In this way, the groove-side abutting surface height/thickness 140 is selected with a balanced design that is sufficiently large to function as the shoulder by structurally maintaining the gap 136 but sufficiently small to avoid squeaking from frictional interpanel contact. From there, the shoulder 128 is designed with the tongue-side abutted surface height/thickness 138 selected to be greater than the groove-side abutting surface height/thickness 140 to ensure that the entire groove-side abutting surface 134 is contacted by the tongue-side abutted surface 130 and to resist collapsing into the groove during installation. Typically, the tongue-side abutted surface height/thickness 138 that is at least 50 percent of the tongue thickness. In the depicted embodiment, the tongue-side abutted surface height/thickness 138 of 0.125 inches is about 60 percent of the 0.210 tongue height/thickness.

It will be noted that the entirety of the G-side abutting surface 134 is contacted by the T-side abutted surface 130. But because the T-side abutted surface 130 is larger than the G-side abutting surface 134, the entirety of the T-side abutted surface 130 is not contacted by the G-side abutting surface 134. As such, the term "abutted surface" is not limited to the surface actually being contacted, but instead refers to the surface that is positioned so that it is available to be contacted, and thus includes the portions of the T-side lower edge immediately above and/or below, and in the same plane as, the surface actually contacted.

Figure 1:
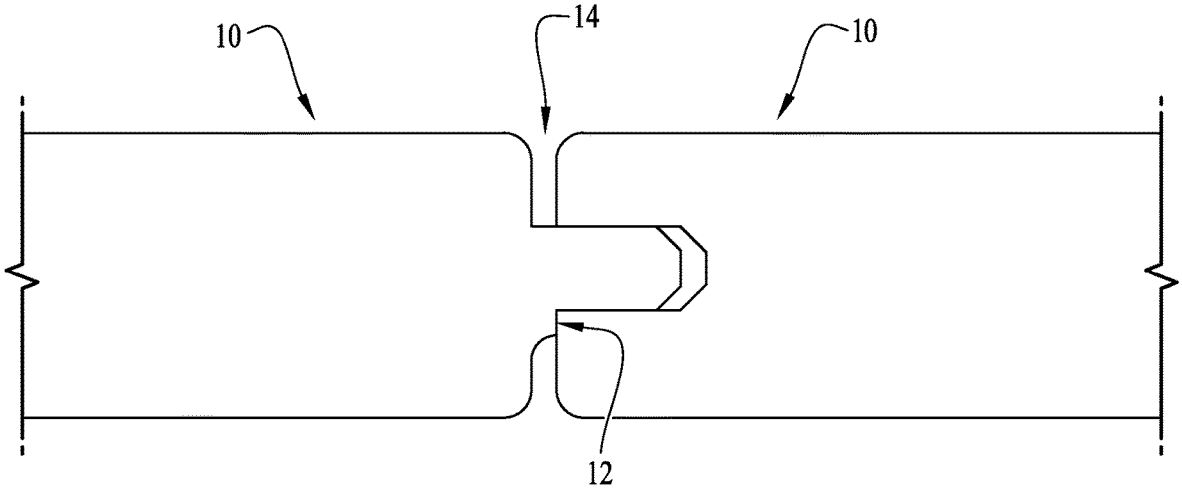
FIG. 1 (PRIOR ART)
FIG. 1 is a side view of portions of two adjacent prior-art tongue-and-groove panels, showing the panels properly inter-engaged together.
Figure 2:
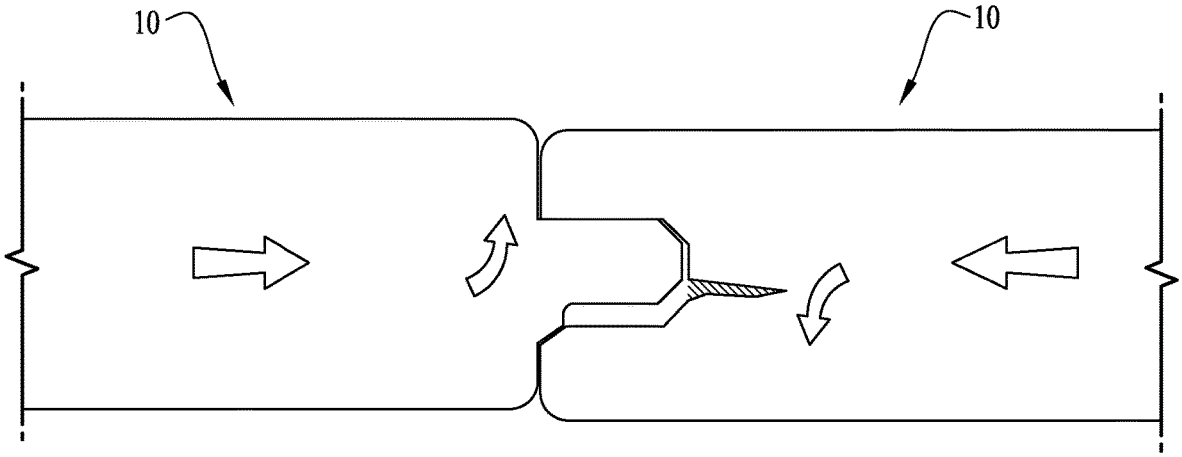
FIG. 2 (PRIOR ART)
FIG. 2 shows the two adjacent prior-art tongue-and-groove panel portions of FIG. 1 being overdriven together to cause ridging.

FIGS. 6-11 shows test results that establish benefits of the improved panel 100 compared to the conventional shoulder panel 10. For these tests, the conventional shoulder panels 10 (shown in FIGS. 1-2) were those available from Huber Engineered Woods under the brand name 24"-oc Advan-Tech, and the improved panels 100 (shown in FIGS. 3-5) were of the same type except with the improved edge profile (so there were no other differences in the improved and conventional panels tested).

Figure 6:
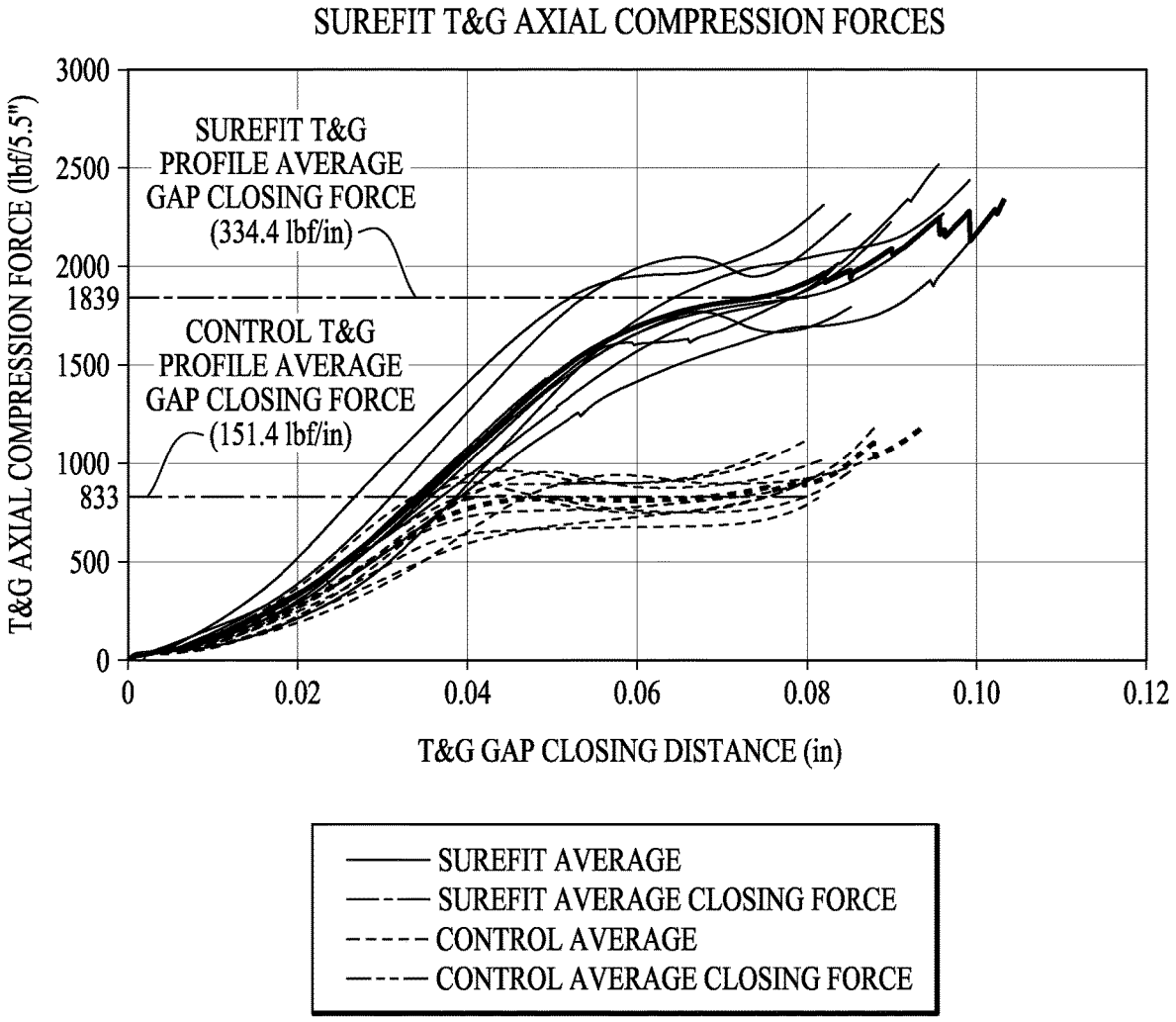
FIG. 6 is a graph showing a plot of axial/lateral compression forces versus gap distances from testing of the panels of FIG. 3 (labeled "SureFit") and the prior-art panels of FIG. 1.
Figure 7:
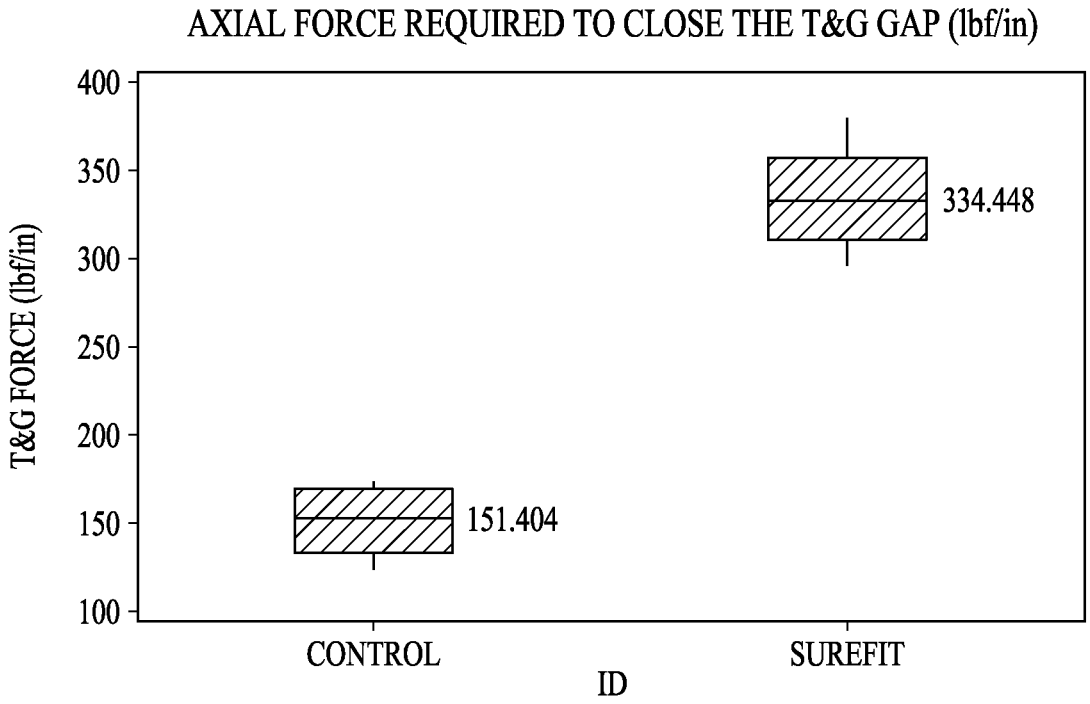
FIG. 7 is a chart showing variances of the magnitudes of the axial/lateral compression forces in FIG. 6 for the SureFit panels of FIG. 3 and the prior-art panels of FIG. 1.

A series of axial compression tests were performed, by applying axial/lateral compression on T&G jointed panel sections, to confirm that a significantly greater force is required to overdrive the improved panels 100 together to close the interpanel gap relative to the conventional panels 10. FIG. 6 is a plot of axial/lateral compression forces versus gap distances closed for the improved panel 100 (SureFit T&G) and the conventional panel 10. Thus, the gap distances closed are the distances the gaps have been closed by the corresponding forces, not the remaining gap sizes at the corresponding forces. And FIG. 7 is a variance chart showing a comparison of the magnitudes of these axial/lateral compression forces, with the heights of the rectangles indicating the variances of the magnitudes. The flattened portions of the curves of FIG. 6 are where the interpanel gap has been closed, indicating that an average axial/lateral compression force of about 334.4 lb/in is required to close the gap on the improved panel 100, whereas only about 151.4 lb/in is required for the conventional panel 10. As such, the improved panels 100 can only be jammed together closing the spacing gap if about 2.2 times the axial/lateral compression force is applied as compared to the conventional panel 10. This effectively minimizes the risk of inexperienced installers on the jobsite forcing closed the self-spacing gap, which would result in the ridging of the joint surfaces due to the eccentric movement of the joint and wedging of the tongue shoulder.

Figure 8:
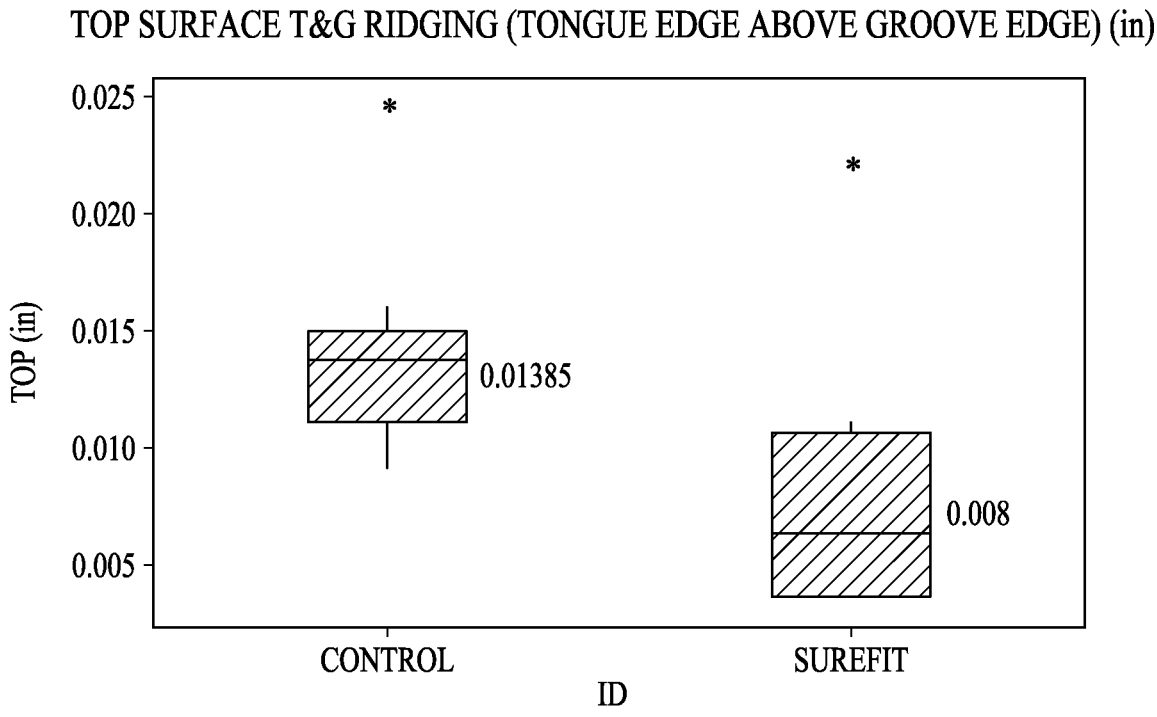
FIG. 8 is a chart showing variances of the magnitudes of top-surface ridging from compression testing of the SureFit panels of FIG. 3 and the prior-art panels of FIG. 1.
Figure 9:
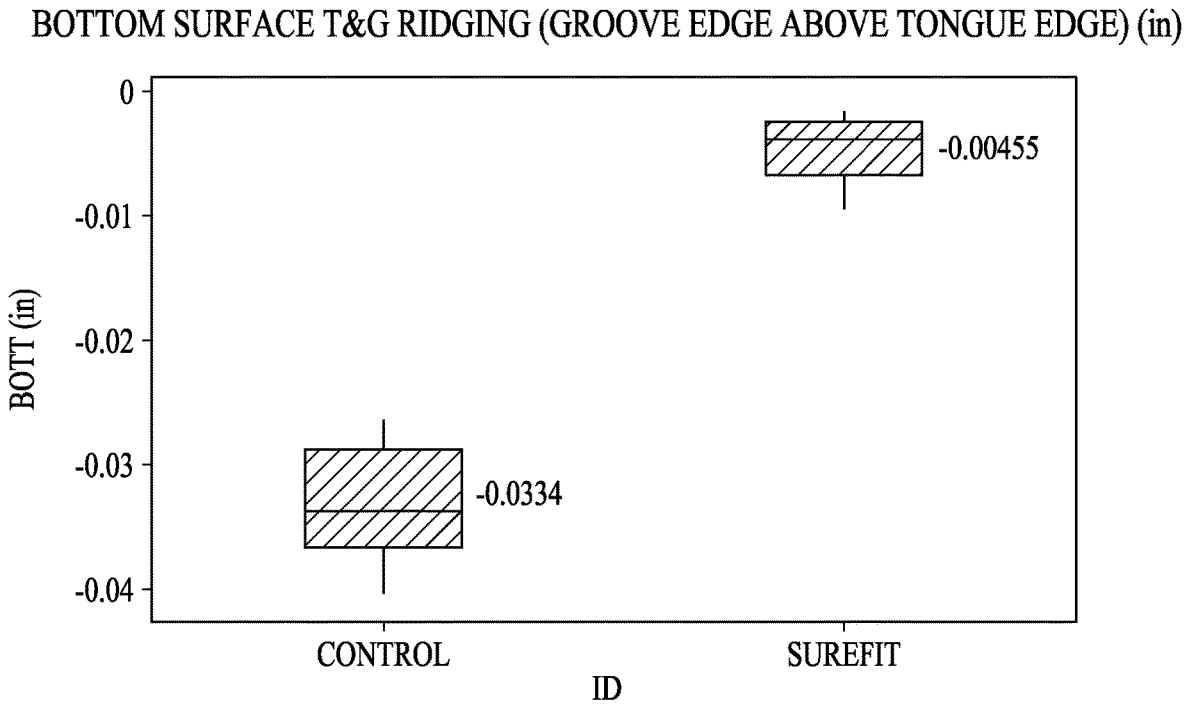
FIG. 9 is a chart showing variances of the magnitudes of bottom-surface ridging from compression testing of the SureFit panels of FIG. 3 and the prior-art panels of FIG. 1.

In addition, a series of compression tests were performed to confirm that a significantly lesser degree of ridging is produced in the improved panels 100 relative to the conventional panels 10. In particular, when the axial/lateral compression force required to close the gap on the conventional panels 10 was applied to the improved panels 100, not only did the improved panels better-maintain the interpanel spacing gap, but there was significantly less ridging produced. FIGS. 8-9 are variance charts showing significant ridging of the conventional panels 10, with the tongue-edge panel deflecting upward and the groove-edge panel deflecting downward (see also FIG. 2), as compared to minimal riding of the improved panels 100 (see also FIG. 4), when the same axial/lateral compression force is applied. (Note that when installed on level floor joists, the panels would be prevented from deflecting downward at those locations, resulting in all the deflection being upward and creating a taller ridge at those locations, but with some downward deflection possible at inter-joist locations and/or at improperly installed joists, resulting in a torqueing effect that adds to the squeaking issue.) In particular, FIG. 8 shows a comparison of the magnitude of the top-surface T&G jointed panel edge ridging and FIG. 9 shows a comparison of the magnitude of the bottom-surface T&G jointed panel edge ridging, with the heights of the rectangles indicating the variances of the respective magnitudes. As can be seen, the improved panels 100 provide a much flatter sub-floor surface (relative to the conventional panels 10) that minimizes any squeaking during use.

Figure 10:
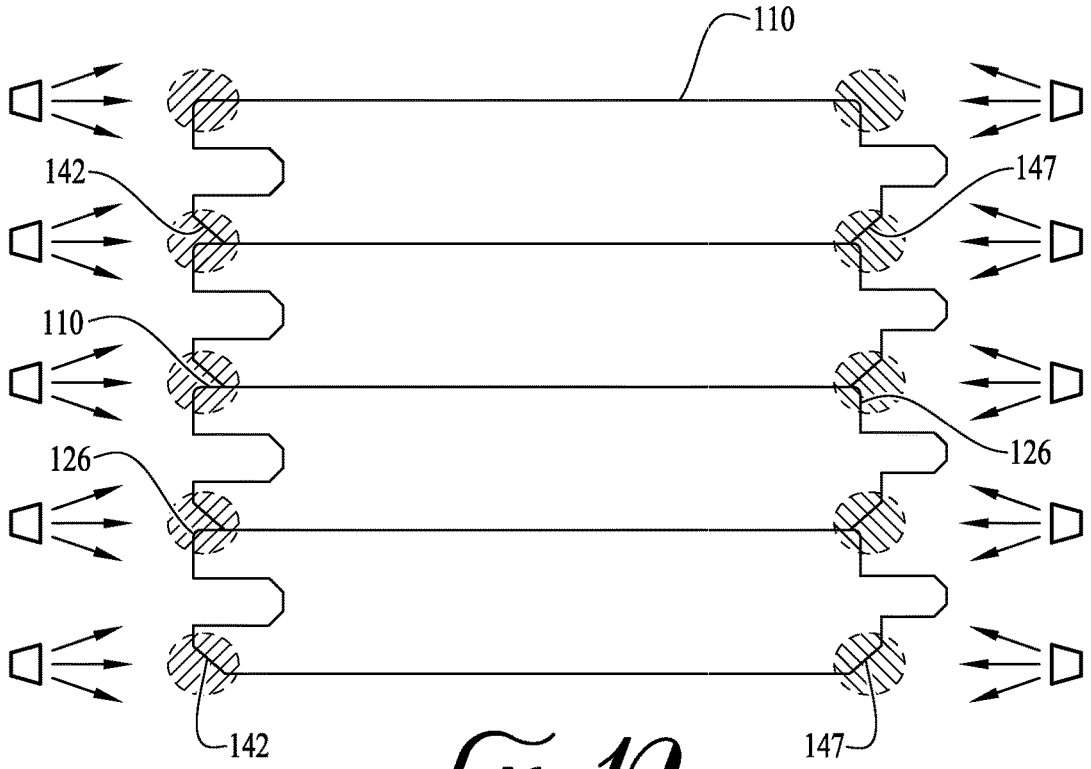
FIG. 10 is a side view of a stack of the panels of FIG. 3, showing edge sealer being applied.

Furthermore, the specially designed edge profile of the SureFit T&G panel 100 greatly enhances edge sealer application coverage and efficiency. For example, FIG. 10 shows four of the panels in a uniformly stacked arrangement with a greater surface area at and adjacent the panel edges (indicated by the circled portions) exposed to a sealer spray. In particular, the slanted bottom transition areas 147 and 142 at the respective tongue-side edge and groove-side edge provide a greater exposed surface area for receiving the sealer spray (relative to conventional bottom/edge intersections without the transitions), and at the same time the respective voids 148 and 144 they provide leave uncovered a greater surface area of the top major surfaces 110. The same applies to the rounded top transitions 126. In addition, any over-sprayed amount will be effectively and efficiently caught/deposited in those voided areas.

This increased edge sealer coverage results in reduced edge swelling of the panels, which in turn helps minimize unevenness and squeaking. This was established by conducting a series of 72-hour kitchen-cabinet tests to determine the edge swelling of the improved panel 100 and the conventional panel 10.

The kitchen-cabinet test is often used to test the effectiveness of a coating on wood-based panel edges against moisture absorption from moist kitchen service environments. In this test, sample panel edges with a coating are stood on a 2"-thick foam laying horizontally on a water bed. The water level is maintained at ⅛" below the surface of the foam. Moisture is wicked in the contacted panel edges evenly during the testing period. Edge thicknesses are measured at the beginning and at the end of the testing. The percent edge thickness swelling is calculated by dividing the swelled amount (the thickness increase due to swelling, at the end of the test) by the original panel edge thickness (at the beginning of the test).

Figure 11:
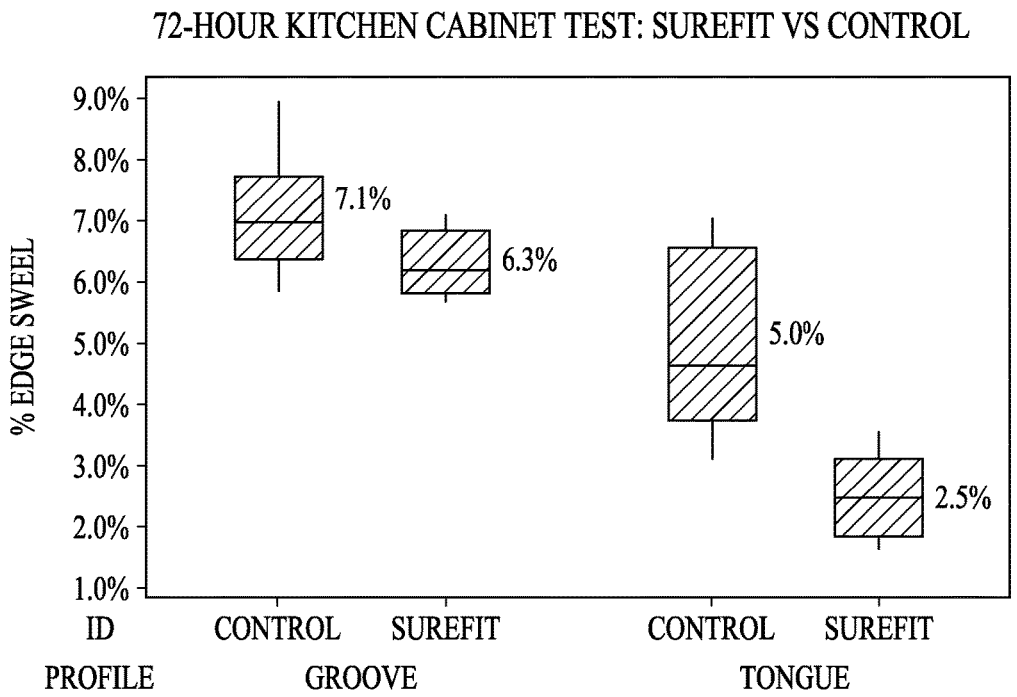
FIG. 11 is a chart showing variances of the magnitudes of swelling at the tongue-side edges and at the groove-side edges from kitchen-cabinet testing of the SureFit panels of FIG. 3 and the prior-art panels of FIG. 1.

FIG. 11 is a variance chart showing a comparison of the percentage increases in the thickness of the panels at their tongue edges and at their groove edges, with the heights of the rectangles indicating the variances. As can be seen, the edge swelling of the improved panels 100 is significantly less than for the conventional panels 10.

FIG. 12 shows a panel 200 with an improved edge profile according to a second example embodiment. The improved panel 200 is the same as the panel 100 of the first embodiment, with a tongue-side shoulder 228 having an abutted surface 230 that is larger than an abutting surface 234 on the groove-side edge, and with the groove-side lower edge surface including a bottom transition 242. In this embodiment, however, the panel 200 does not include a bottom transition at the tongue-side lower edge surface (the intersection between the panel bottom surface and the shoulder.

As such, the improved panel 200 provides the same advantages, except for the increased edge sealant coverage and thus the resulting reduced edge swelling.

Accordingly, various embodiments provide various advantages over conventional tongue-and-groove panels. For example, the thicker shoulder eliminates installation error resulting from overdriving the panels together. The thicker shoulder also reduces panel ridging from acentric movement resulting from overdriving or from environmental factors in use. The minimized/optimized panel edge contact surface area eliminates squeaks. And the maximized/optimized panel slanted transitions between the edges and the top/bottoms enable increased edge sealant coverage resulting in reduced edge swelling from moisture absorption during use. In addition, the tongue-and-groove edge profile can be incorporated into existing tongue-and-groove panel designs, without changing the top/bottom surface width of the panels, and with the resulting improved panels mating with the existing panels.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A building-construction panel, comprising:

opposite top and bottom major surfaces, with two opposite end surfaces extending between them at panel transverse ends, and with two opposite side edge surfaces extending between them at panel longitudinal sides;

a tongue extending from one of the edge surfaces and a groove recessed into an opposite one of the edge surfaces so that when two of the panels are positioned flat adjacent to each other the tongue of one panel is matingly received into the groove of the adjacent panel in an inter-engaged arrangement, wherein the edge surfaces include tongue-side upper and lower edges above and below the tongue and groove-side upper and lower edges above and below the groove;

a shoulder formed on the tongue-side lower edge immediately below the tongue and defining a tongue-side abutted surface; and a bottom transition formed on the groove-side lower edge immediately above the panel bottom major surface, wherein an abutting surface is defined by the groove-side lower edge above the bottom transition, on the groove-side lower edge, wherein the abutted surface on the tongue-side lower edge extends higher and lower than the abutting surface on the groove-side lower edge, wherein when the two adjacent panels are installed together, the abutting surface on the groove-side lower edge contacts the abutted surface on the tongue-side lower edge with mechanical interference to structurally maintain a gap between the tongue-side and groove-side upper edges of the panel, wherein the tongue-side abutted surface has a height that is greater than a height of the groove-side abutting surface so that the relatively smaller groove-side abutting surface structurally maintains the gap but also minimizes frictional interpanel contact to minimize squeaking, and wherein the relatively larger tongue-side abutted surface structurally resists being collapsed into the groove during installation.

2. The building-construction panel of claim 1, wherein the tongue-side abutted surface is laterally offset from the tongue-side upper edge to form the gap.

3. The building-construction panel of claim 1, wherein the groove-side abutting surface height is selected with a balanced design so that the groove-side abutting surface functions as the shoulder by structurally maintaining the gap but also avoids squeaking from frictional interpanel contact, and wherein the tongue-side abutted surface height is selected to be greater than the groove-side abutting surface height to ensure that the entire groove-side abutting surface is contacted by the tongue-side abutted surface and to resist collapsing into the groove during installation.

4. The building-construction panel of claim 1, wherein a lowest portion of the groove-side abutting surface is higher than a lowest part of the tongue-side abutted surface.

5. The building-construction panel of claim 1, wherein the entire groove-side abutting surface contacts the tongue-side abutted surface, but the entire tongue-side abutted surface does not contact the groove-side abutting surface.

6. The building-construction panel of claim 1, wherein the groove-side abutting surface height is about 0.0312 inches to about 0.1 inches.

7. The building-construction panel of claim 1, wherein the groove-side abutting surface height is about 10 percent to about 16 percent of a thickness of the panel between the top and bottom major surfaces.

8. The building-construction panel of claim 1, wherein the groove-side abutting surface height is about 35 percent to about 45 percent of a thickness of the groove.

9. The building-construction panel of claim 1, wherein the groove-side abutting surface height is less than half of an overall height of the groove-side lower edge between the groove and the panel bottom major surface.

10. The building-construction panel of claim 1, wherein the tongue-side abutted surface height is at least 50 percent of that of the tongue.

11. The building-construction panel of claim 1, wherein the groove-side bottom transition is a slanted or sloped surface.

12. A building-construction panel, comprising:

opposite top and bottom major surfaces, with two opposite end surfaces extending between them at panel transverses ends, and with two opposite side edge surfaces extending between them at panel longitudinal sides;

a tongue extending from one of the edge surfaces and a groove recessed into an opposite one of the edge surfaces so that when two of the panels are positioned flat adjacent to each other the tongue of one panel is matingly received into the groove of the adjacent panel in an inter-engaged arrangement, wherein the edge surfaces include tongues-side upper and lower edges above and below the tongue and groove-side upper and lower edges above and below the groove;

a shoulder formed on the tongue-side lower edge immediately below the tongue and defining a tongue-side abutted surface; and a groove-side bottom transition formed on the groove-side lower edge immediately above the panel bottom major surface, wherein a groove-side abutting surface is defined by the groove-side lower edge above the groove-side bottom transition on the groove-side lower edge; and a tongue-side bottom transition formed on the tongue-side lower edge immediately above the panel bottom major surface, wherein the shoulder is defined by the edge surface on the tongue-side lower edge above the tongue-side bottom transition, and wherein the groove-side bottom transition on the groove-side lower edge extends higher than the tongue-side bottom transition on the tongue-side lower edge, wherein when the two adjacent panels are installed together, the groove-side abutting surface contacts the tongue-side abutted surface with mechanical interference to structurally maintain a gap between the tongue-side and groove-side upper edges of the panel, wherein the tongue-side abutted surface has a height that is greater than a height of the groove-side abutting surface so that the relatively smaller groove-side abutting surface structurally maintains the gap but also minimizes frictional interpanel contact to minimize squeaking, and wherein the relatively larger tongue-side abutted surface structurally resists being collapsed into the groove during installation.

13. The building-construction panel of claim 1, wherein the mating tongue and groove of the two adjacent panels inter-engage to prevent relative movement of the two adjacent panels in a direction transverse to a plane of the tongue and groove but do not interlock to prevent the two adjacent panels from being moved apart longitudinally in the tongue and groove plane.

14. The building-construction panel of claim 1, wherein the panel is a structural wood subflooring panel configured to be laid flat over and mounted down onto flooring joists to form a structural subfloor of a building structure and configured to have a non-structural decorative floor covering installed over it.

15. The building-construction panel of claim 1, wherein during manufacture a plurality of the panels can be arranged in a stack and the groove-side bottom transitions expose portions of one of the major surfaces of the adjacent stacked panels to application of edge sealers to protect against later edge swelling during use.

16. A structural wood subflooring panel, comprising:

opposite top and bottom major surfaces, with two opposite end surfaces extending between them at panel transverse ends, and with two opposite side edge surfaces extending between them at panel longitudinal sides;

a tongue extending from one of the edge surfaces and a groove recessed into an opposite one of the edge surfaces so that when two of the panels are positioned flat adjacent to each other the tongue of one panel is matingly received into the groove of the adjacent panel in an inter-engaged arrangement, wherein the edge surfaces include tongues-side upper and lower edges above and below the tongue and groove-side upper and lower edges above and below the groove;

a shoulder formed on the tongue-side lower edge immediately below the tongue and defining a tongue-side abutted surface; and a groove-side bottom transition formed on the groove-side lower edge immediately above the panel bottom major surface, wherein a groove-side abutting surface is defined by the groove-side lower edge above the groove-side bottom transition, wherein when the two adjacent panels are installed together, the groove-side abutting surface contacts the tongue-side abutted surface with mechanical interference to structurally maintain a gap between the tongue-side and groove-side upper edges of the panel, wherein the tongue-side abutted surface has a height that is greater than a height of the groove-side abutting surface so that the relatively smaller groove-side abutting surface structurally maintains the gap but also minimizes frictional interpanel contact to minimize squeaking, wherein the relatively larger tongue-side abutted surface structurally resists being collapsed into the groove during installation, wherein the tongue-side abutted surface extends higher and lower than the groove-side abutting surface, wherein the entire groove-side abutting surface contacts the tongue-side abutted surface, but the entire tongue-side abutted surface does not contact the groove-side abutting surface, and wherein a lowest portion of the groove-side abutting surface is higher than a lowest part of the tongue-side abutted surface.

17. The building-construction subflooring panel of claim 16, wherein the groove-side abutting surface height is selected with a balanced design so that the groove-side abutting surface functions as the shoulder by structurally maintaining the gap but also avoids squeaking from frictional interpanel contact, and wherein the tongue-side abutted surface height is selected to be greater than the groove-side abutting surface height to ensure that the entire groove-side abutting surface is contacted by the tongue-side abutted surface and to resist collapsing into the groove during installation.

18. The building-construction subflooring panel of claim 16, wherein the groove-side abutting surface height is:

about 0.0312 inches to about 0.1 inches;

about 10 percent to about 16 percent of a thickness of the panel between the top and bottom major surfaces;

about 35 percent to about 45 percent of a thickness of the groove; or less than half of an overall height of the groove-side lower edge between the groove and the panel bottom major surface.

19. The building-construction panel of claim 1, further comprising a tongue-side bottom transition formed on the tongue-side lower edge immediately above the panel bottom major surface, wherein the shoulder is defined by the tongue-side edge surface above the tongue-side bottom transition, wherein the tongue-side bottom transition extends higher than the groove-side bottom transition, and wherein the tongue-side abutted surface height is at least 50 percent of that of the tongue.

20. The building-construction panel of claim 12, wherein the tongue-side abutted surface extends higher and lower than the groove-side abutting surface.

* * * * *